US006676427B2

(12) United States Patent
Hung et al.

(10) Patent No.: US 6,676,427 B2
(45) Date of Patent: Jan. 13, 2004

(54) HOUSING STRUCTURE OF A CONNECTOR

(75) Inventors: Teng-Sheng Hung, Hsin-Chuang (TW); Chien-Hsun Chien, ping-Chen (TW)

(73) Assignee: Speed Tech Corp., Taoyuan (TW)

( * ) Notice: Subject to any disclaimer, the term of this patent is extended or adjusted under 35 U.S.C. 154(b) by 0 days.

(21) Appl. No.: 10/154,803

(22) Filed: May 28, 2002

(65) Prior Publication Data

US 2003/0224644 A1 Dec. 4, 2003

(51) Int. Cl.[7] ..... H01R 11/22
(52) U.S. Cl. ..... 439/266; 439/933
(58) Field of Search ..... 439/266, 736, 439/604–606, 933

(56) References Cited

U.S. PATENT DOCUMENTS 3,871,733 A * 3/1975 Praeger et al. ..... 439/325
5,795,193 A * 8/1998 Yang ..... 439/621
6,494,724 B1 * 12/2002 Bixler et al. ..... 439/79

* cited by examiner

*Primary Examiner*—Gary Paumen
(74) *Attorney, Agent, or Firm*—Troxell Law Office PLLC

(57) ABSTRACT

A housing structure of a connector having a plurality of parallel terminal channels formed on two lateral sides and separated from each other by ribs. A central portion of the housing is recessed to form a hollow section. The periphery of the hollow section is formed with a spacing section for separating the hollow section from the respective terminal channels and ribs. At least one central rib is longitudinally formed in the hollow section. Two sides of the central rib are formed with multiple laterally extending reinforcing ribs opposite to each other. The reinforcing ribs connect the central rib with the spacing section. An end section of each reinforcing rib connecting with the spacing section is tapered to form a narrowed section.

2 Claims, 4 Drawing Sheets

HOUSING STRUCTURE OF A CONNECTOR

BACKGROUND OF THE INVENTION

The present invention is related to a housing structure of a connector. When demolded, the housing is prevented from deforming. In addition, the injected material can be better conducted to ensure good quality of the product and lower manufacturing cost.

It is a trend to minimize the volume of computers and electronic products. Accordingly, various mini-connectors are used in such computers and electronic products. Numerous terminals are densely accommodated in a very small space of the mini-connector so that the pitch between the terminals is very small. As a result, it is harder and harder to process and manufacture the fine parts of the connector. For example, it is hard to form the slender terminal and keep it resilient and rigid. In addition, it is hard by injection molding to manufacture the housing of the connector with precise dimension.

FIG. 1 is a bottom view showing the housing of a conventional connector. Two lateral sides of the housing 4 are formed with multiple densely arranged terminal channels 41 separated by ribs 42. The central portion (generally of the bottom side) of the housing 4 is formed with a hollow section 43 for saving injection material. A spacing section 44 with a certain width is reserved between the hollow section 43 and the terminal channels 41 (or the ribs 42) for stopping the inserted terminals and connecting the ribs 42 by a certain strength. The terminal channels 41 are formed in such a manner that multiple parallel core pins are extended into the mold. After the material is injected and molded, the terminal channels 41 are formed in the positions of the core pins. The gaps between the core pins naturally form the ribs 42 after molded. Following the reduction of the volume of the connector, the pitch of the terminals, the width of the terminal channels 41 and the thickness of the ribs 42 are minimized. Accordingly, the core pins are quite slender and thin and the gap between the core pins is extremely small. As a result, when molding the housing 4, the material can be hardly smoothly conducted into the gap between the core pins. Moreover, only the very narrow spacing section 44 serves as the flow way through which the injected material is conducted to the positions of the ribs 42 around the hollow section 43. Therefore, it is even harder to conduct the material. In order to avoid defective or deformed product resulting from poor flowability and conduction of the injected material, generally the injection pressure is increased. By means of the greater pressure, the injected material can fully flow into the gap between the core pins to form the rib 42. However, the excessively great injection pressure is very easy to bend and deform the core pins and thus affect the dimensional precision of the product of the housing 4. In addition, the great pressure makes it necessary to frequently service the mold and the cost is increased. Also, the using life of the mold is shortened. Therefore, it is necessary to design an optimal flow way to reduce the injection pressure and eliminate the above problems.

SUMMARY OF THE INVENTION

It is therefore a primary object of the present invention to provide a housing structure of a connector. A central portion of the housing is recessed to form a hollow section. At least one central rib is longitudinally formed in the hollow section. Two sides of the central rib are formed with multiple laterally extending reinforcing ribs opposite to each other.

By means of the central rib and the reinforcing ribs, the periphery of the hollow section of the housing is prevented from deforming when demolded. In addition, the reinforcing ribs also serve to conduct the material and enhance the flowability of the injected material. Therefore, the injection pressure can be reduced to minimize damage of the mold.

It is a further object of the present invention to provide the above housing structure in which an end section of each reinforcing rib connecting with the periphery of the hollow section is tapered to form a narrowed section. The narrowed section avoids contraction after cooled due to excessive thickness. Therefore, the precision of the dimension of respective parts of the housing can be ensured.

The present invention can be best understood through the following description and accompanying drawings wherein:

DETAILED DESCRIPTION OF THE PREFERRED EMBODIMENT

Figure 1:
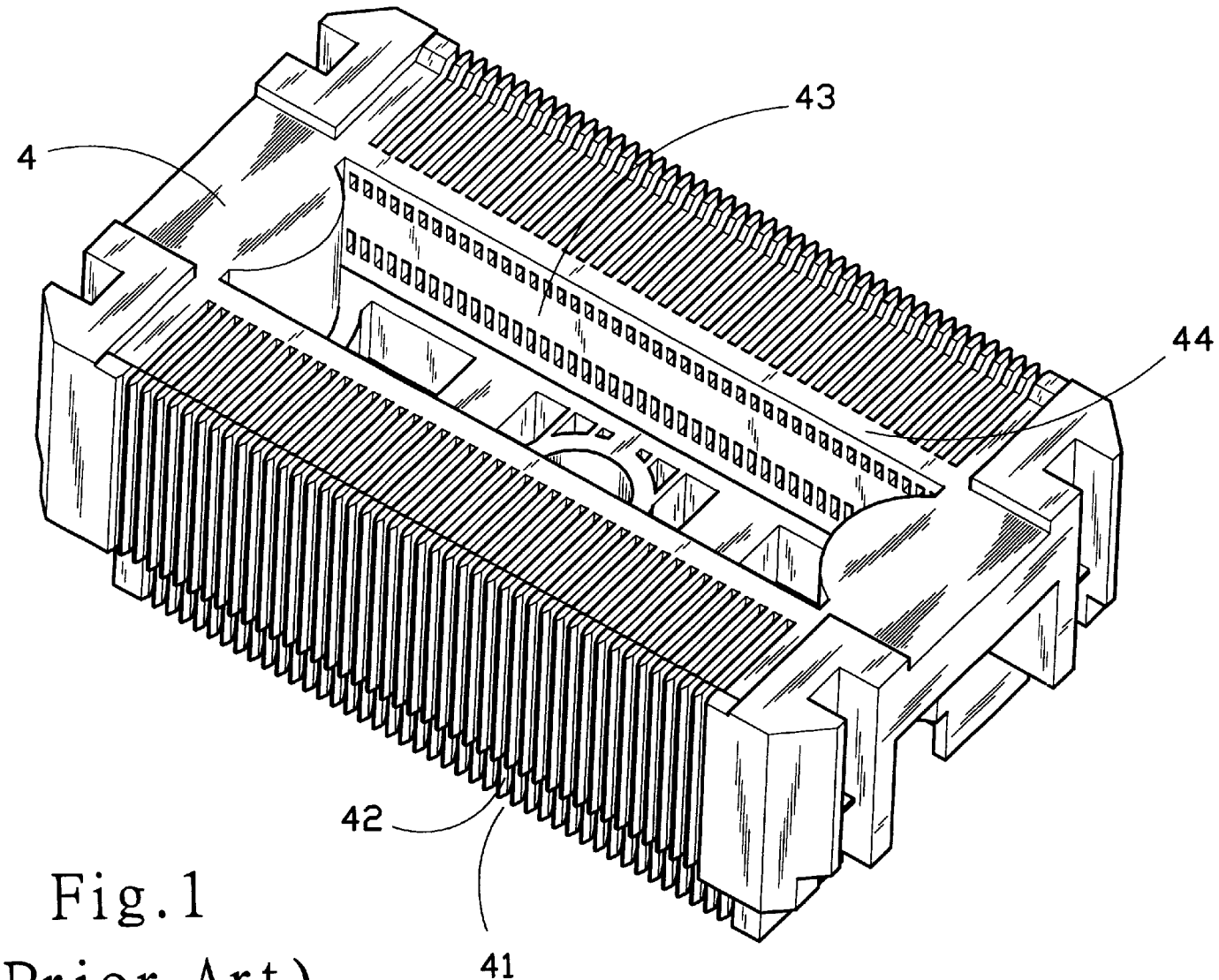
Fig.1 (Prior Art)
FIG. 1 is a bottom perspective view of a conventional connector housing.
Figure 2:
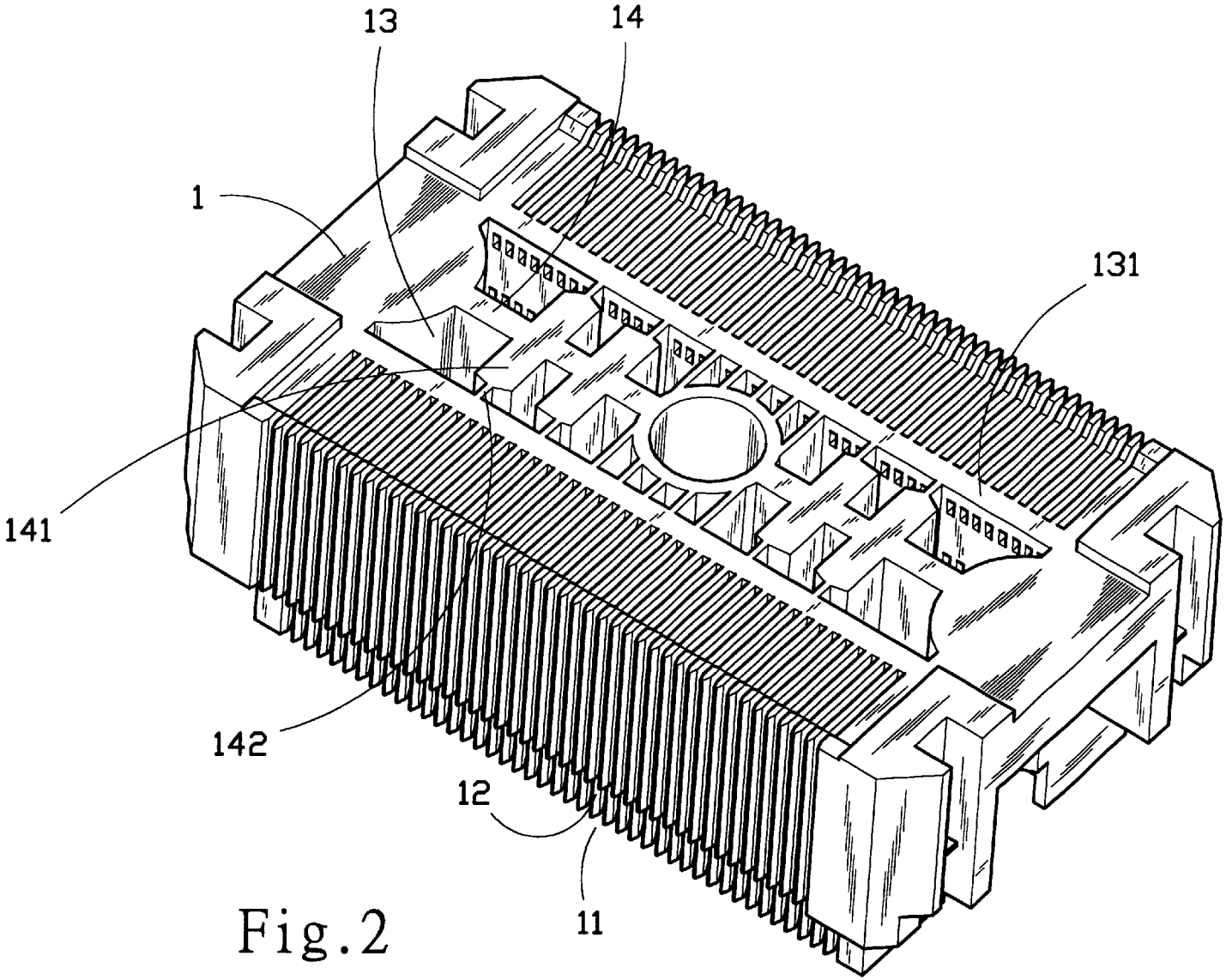
FIG. 2 is a bottom perspective view of the housing structure of the present invention.

Please refer to FIG. 2 which shows the bottom side of the housing of the connector of the present invention. Two lateral sides of the housing 1 are respectively formed with multiple densely arranged terminal channels 11 separated from each other by ribs 12. The bottom side of the housing 1 is recessed to form a hollow section 13. The periphery of the hollow section 13 is formed with a spacing section 131 for separating the hollow sect ion 13 from the respective terminal channels 11 (or the ribs 12) for stopping the inserted terminals and connecting the ribs 12 by a certain strength. At least one central rib 14 is longitudinally formed in the hollow section 13. Two sides of the central rib 14 are formed with multiple laterally extending reinforcing ribs 141 opposite to each other. The reinforcing ribs 141 connect the central rib 14 with the spacing section 131. An end section of each reinforcing rib 141 connecting with the spacing section 131 is tapered to form a narrowed section 142.

By means of the central rib 14 and the reinforcing ribs 141, the periphery of the hollow section 13 of the housing 1 is prevented from deforming when demolded. In addition, the reinforcing ribs 141 also serve to conduct the material and enhance the flowability of the injected material. Therefore, the injection pressure can be reduced to minimize damage of the mold and prolong using life thereof. The narrowed section 142 of the end section of the reinforcing rib 141 avoids contraction after cooled due to excessive thickness. Therefore, the precision of the dimension of respective parts of the housing 1 can be ensured.

Figure 3:
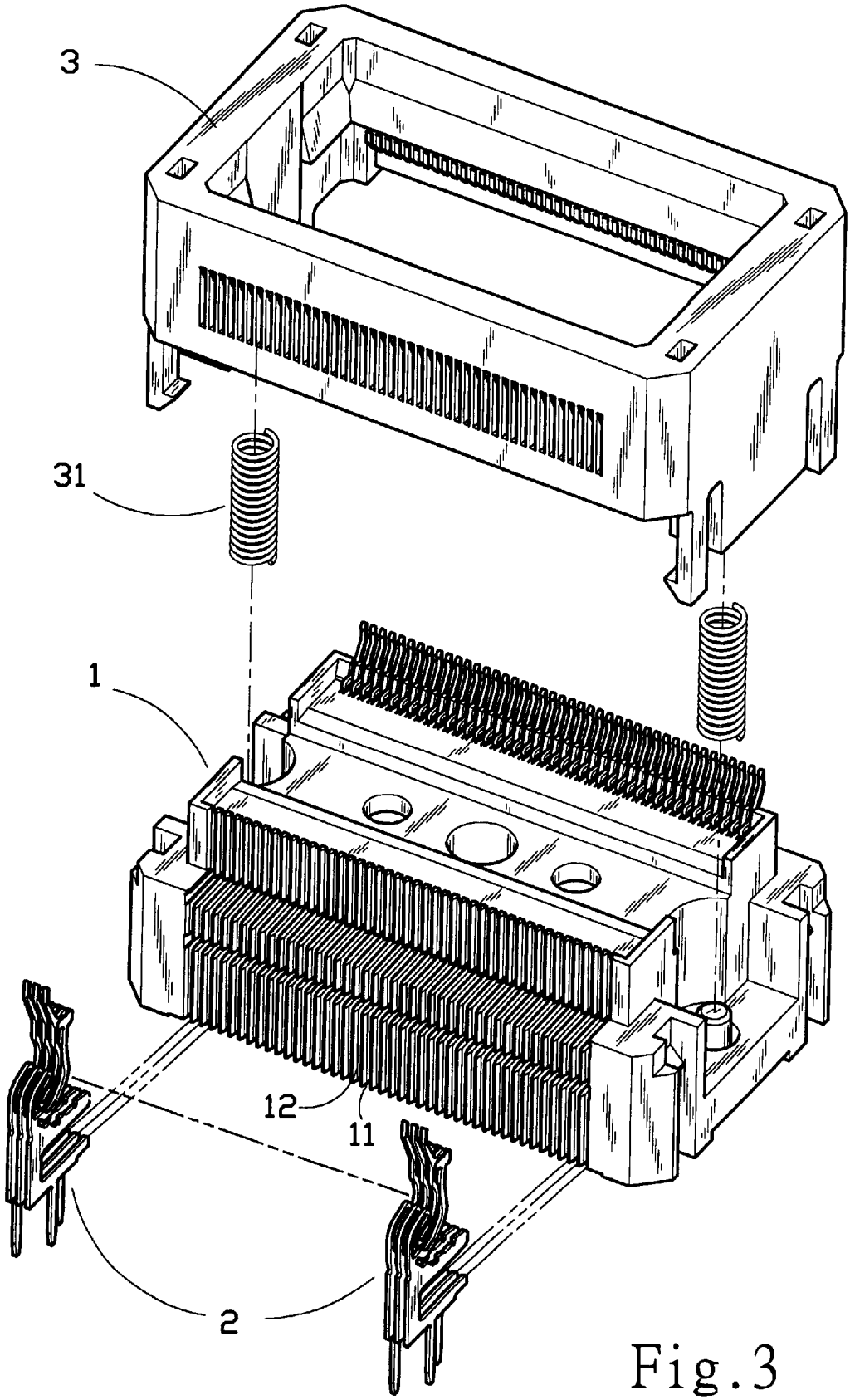
FIG. 3 is a perspective exploded view of a connector (burn-in socket) of the present invention.
Figure 4:
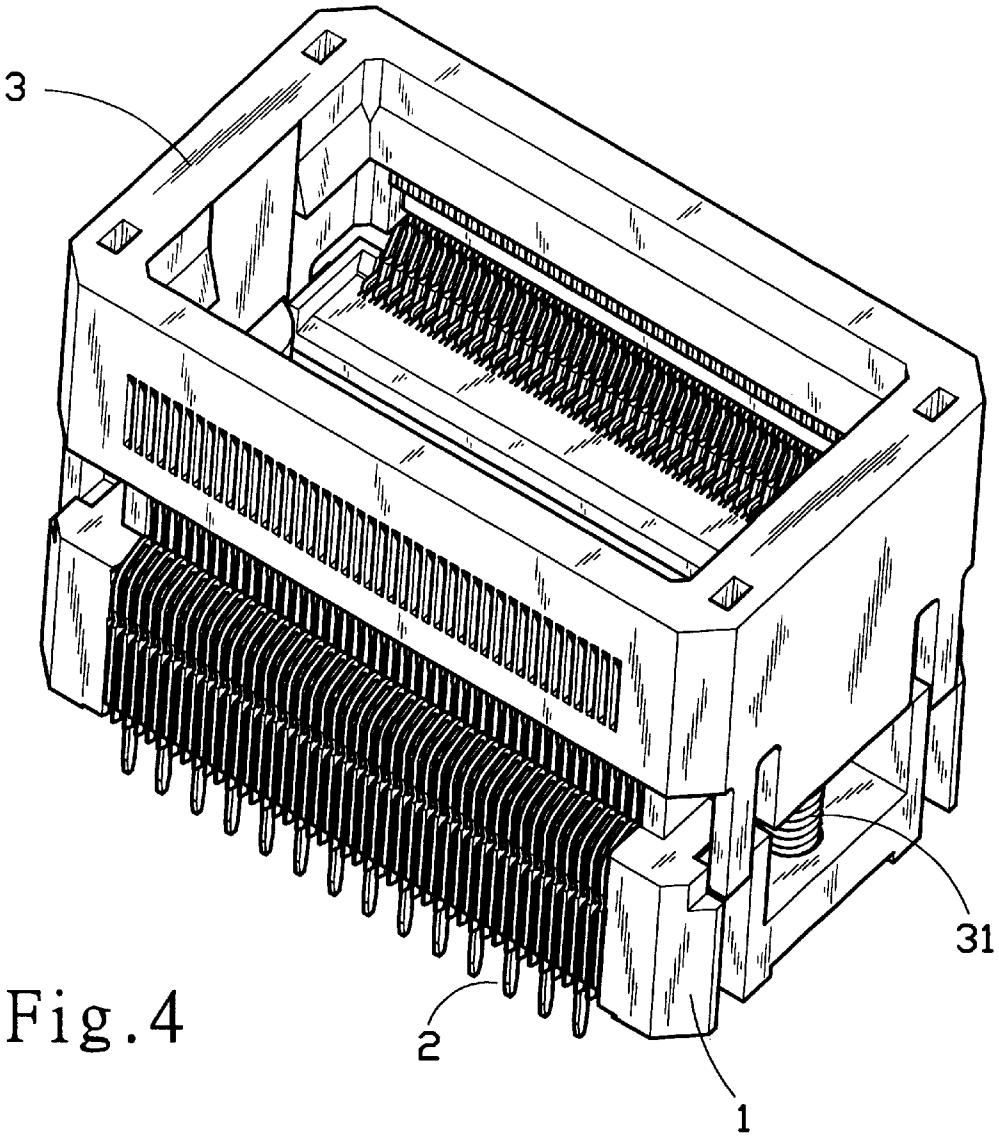
FIG. 4 is a perspective assembled view of the connector (burn-in socket) of the present invention.

FIG. 3 is a top perspective exploded view (reverse to the direction of FIG. 2) of a connector (burn-in socket) of the present invention. Also referring to FIG. 4, when assembled, corresponding portions of the respective terminals 2 are inlaid in the terminal channels 11 of the housing 1. The bottoms of the terminals 2 downward extend. An upper cover 3 is fitted onto the top side of the housing 1 to cover the same. Multiple springs 31 are compressed between the housing 1 and the upper cover 3, whereby the upper cover 3 is resiliently connected with the housing 1 to form a burn-in socket.

The above embodiment is only used to illustrate the present invention, not intended to limit the scope thereof. Many modifications of the above embodiment can be made without departing from the spirit of the present invention.

What is claimed is:

1. A housing for a connector comprising:

a) a plurality of parallel terminal channels formed on two opposing sides of the housing;

b) a plurality of ribs formed between and separating the plurality of terminal channels;

c) a hollow section formed in a recessed central portion of the housing;

d) a spacing section formed on a periphery of the hollow section, the spacing section separating the plurality of terminal channels and the plurality of ribs from the hollow section;

e) at least one central rib longitudinally formed in the hollow section; and f) a plurality of reinforcing ribs formed on opposing sides of the at least one central rib, the plurality of reinforcing ribs connecting the central rib with the spacing section.

2. The housing structure of a connector according to claim 1, wherein each of the plurality reinforcing ribs has a narrowed section formed by tapering an end of each reinforcing rib adjacent to the spacing section.

* * * * *